United States Patent [19]

Park et al.

[11] Patent Number: 4,616,534

[45] Date of Patent: Oct. 14, 1986

[54] CLOSED END WRENCH

[76] Inventors: Sea C. Park; In Pio Park, both of 3836 Birchwood, Skokie, Ill. 60076

[21] Appl. No.: 664,039

[22] Filed: Oct. 23, 1984

[51] Int. Cl.[4] ..... B25B 13/28

[52] U.S. Cl. ..... 81/99

[58] Field of Search ..... 81/99, 103, 104, 105

[56] References Cited

U.S. PATENT DOCUMENTS

| | | | |
|---|---|---|---|
| 291,933 | 1/1884 | Porter | 81/99 |
| 706,042 | 8/1902 | Fields | 81/99 |
| 897,665 | 9/1908 | Rugg | 81/99 |
| 2,713,803 | 7/1955 | Schwaiger | 81/99 |

*Primary Examiner*—James L. Jones, Jr.

*Attorney, Agent, or Firm*—Birch, Stewart Kolasch & Birch

[57] ABSTRACT

A wrench comprising a body member having a lower jaw disposed at one end thereof, a head member having a spring engaging surface and a base engaging surface, the head member being pivotally connected to the body member in the vicinity of the lower jaw and defining an upper jaw, a handle member pivotally connected to the body member, biasing spring disposed between the body member and the handle member for biasing the handle member away from the body member, the handle member containing a lever engaging end portion which slidably engages the base engaging surface of the head member for separating the upper jaw of the head member from the lower jaw of the body member through the squeezing of the handle member toward the body member against the bias of the biasing spring, and a retaining spring attached at one end to the body and at the other end of the spring engaging surface of the head member, whereby, when the handle is released, the upper jaw of the head member is caused to close toward the lower jaw by the action of the retaining spring.

1 Claim, 3 Drawing Figures

CLOSED END WRENCH

BACKGROUND OF THE INVENTION

The present invention relates to a closed end wrench and more particularly to a wrench which can be closed around an object and operated with little effort being required by the user. Wrenches are known in the art which utilize a retaining spring for closing the jaws of the wrench. In such devices the thumb must be utilized to open the mouth of the wrench against the bias of a spring and then the thumb is released to permit the jaws of the wrench to close around the desired object. Such devices, however, are difficult to operate and because of the necessary hand manipulations which are required close to the jaws of the wrench, its use in confined areas is seriously restricted.

OBJECT AND SUMMARY OF THE INVENTION

Accordingly, it is an object of the present invention to provide an improved closed end wrench.

Another object of the present invention is to provide the wrench which is easy to operate and possesses a strong grasping power.

A further object of the present invention is to provide a wrench which can be manipulated in a small space and achieve a strong grasping strength utilizing a retaining spring.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention provides a closed end wrench which enables the user to control the size of the opening of the wrench jaws from the end of the wrench handle.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 2:
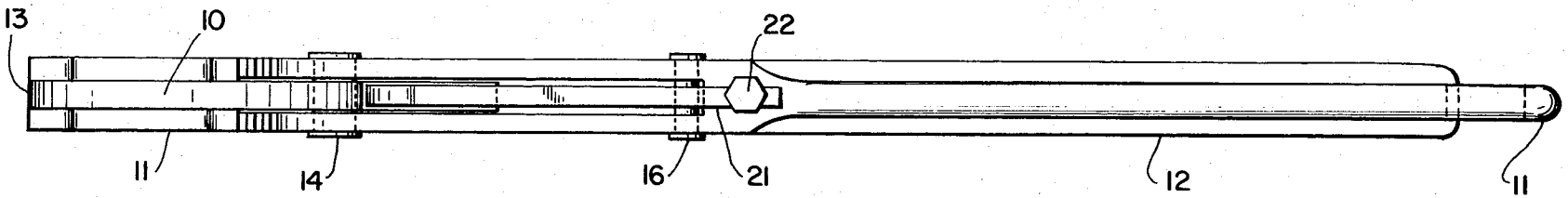
FIG. 2 is is a top view of the wrench of the present invention as shown in FIG. 1.
Figure 1:
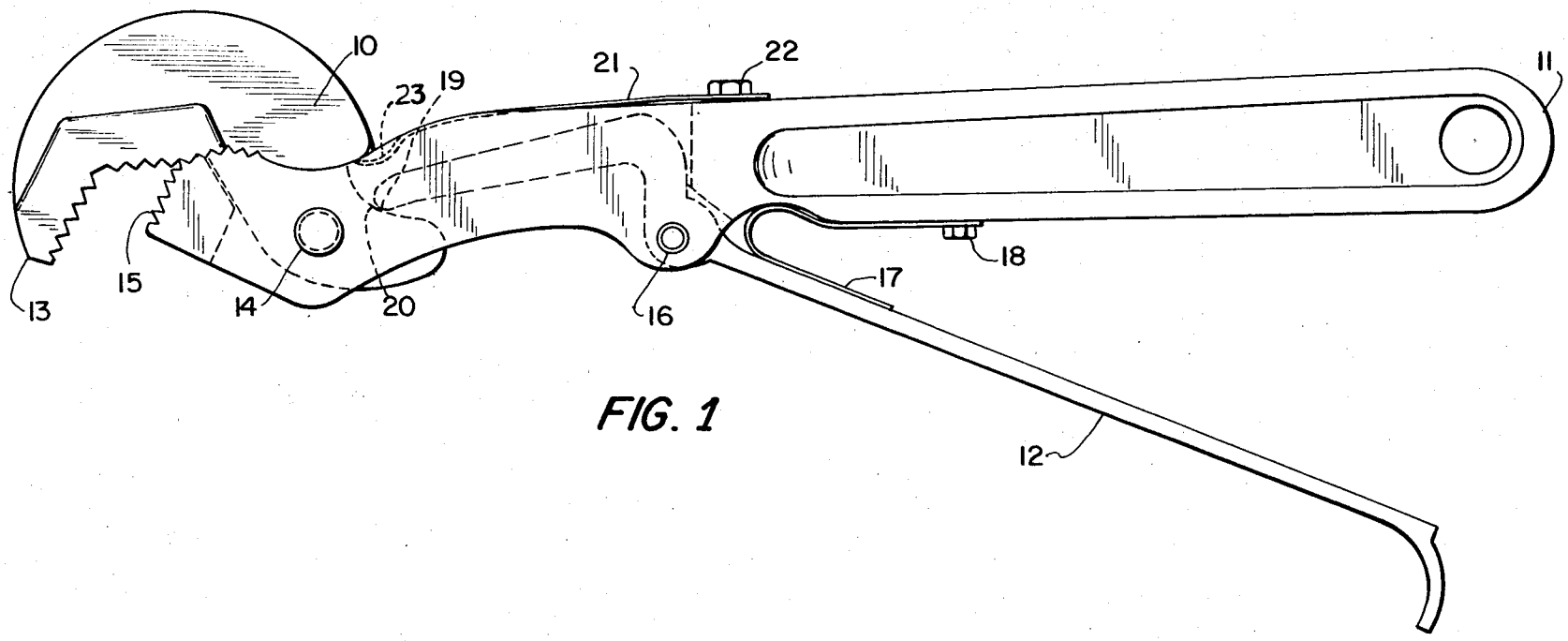
FIG. 1 is a side view of the wrench of the preent invention with the jaws of the wrench in a position.
Figure 3:
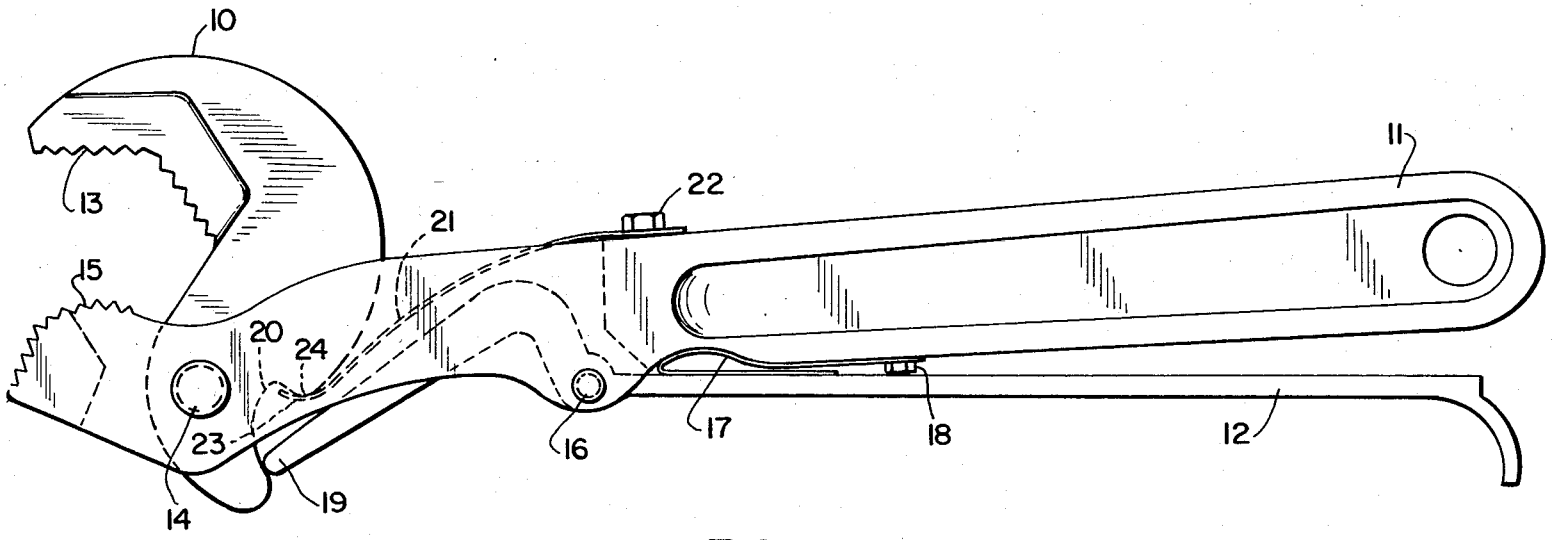
FIG. 3 is a side view of the wrench of the present invention with the jaws of the wrench in a closed position.

Referring in detail to the drawings for the purpose of illustrating the present invention, the closed end wrench as shown in FIGS. 1, 2 and 3 comprises a head 10, a body 11 and a handle 12.

The head 10 is provided with a jaw 13 at the end thereof and is fixed to the body 11 by a pivot pin 14. The end portion of the body 11 is also provided with a jaw

15. The handle 12 is pivotally connected to the body 11 by pivot pin 16.

The handle 12 is biased away from the body 11 by an extension spring 17 which is attached to the body 11 by a pin member 18. To open the jaws of the wrench, the handle 12 is squeezed toward the body 11 against the bias spring 17 which causes the lever end portion 19 of the handle 12 to travel along surface 20 of the head 10 causing the upper jaw 13 to open away from the lower jaw 15. After the jaws of the wrench have been positioned around a desired object, the handle 12 is released and the jaws are drawn toward each other and around a object by the retaining spring 21 which is attached to the wrench body 11 by a screw member 22. The retaining spring 21 contains an indent portion 23 at the end thereof for engagement with a spring engaging protrusion surface 24 disposed on the head member 10. The retaining spring 14 is strongly biased against the head member 10 to resist the opening of the jaws 13 and 15 so that when the handle 12 is released, the retaining spring 21 strongly pulls the upper jaw toward the lower jaw.

Because the jaws of the wrench of the present invention can be easily opened by squeezing the handle 12, the jaws of the wrench can be easily manipulated around any size object at a distance from the object. Also, by merely releasing the handle 13 the jaws of the wrench are automatically and strongly closed around the object, no matter what its size. Accordingly, since a spring preforms the squeezing motion of the wrench jaws, the wrench can be operated with little effort by the user.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is

1. A wrench comprising a body member having a lower jaw disposed at one end thereof, a head member having a spring engaging protrusion surface and a base engaging surface, said head member being pivotally connected to the body member in the vicinity of the lower jaw and defining an upper jaw, a handle member pivotally connected to the body member, a biasing spring disposed between said body member and said handle member for biasing said handle member away from said body member, said handle member containing a lever engaging end portion which slidably engages the base engaging surface of the head member for separating the upper jaw of the head member from the lower jaw of the body member through the squeezing of the handle member toward the body member against the bias of the biasing spring and a retaining spring attached at one end to the body and at an indent portion at the other end with the spring engaging protrusion surface of the head member, whereby, when the handle is released, the upper jaw of the head member is caused to close toward the lower jaw by the action of the retaining spring.

* * * * *